US005380194A

United States Patent [19]

Polomchak et al.

[11] Patent Number: 5,380,194

[45] Date of Patent: Jan. 10, 1995

[54] HEATING DEVICE

[76] Inventors: Robert W. Polomchak, R.R. 1; Michael Yacko, R.R. #1, Box 125, both of Fair Oaks, Ind. 47943

[21] Appl. No.: 78,075

[22] Filed: Jun. 15, 1993

Related U.S. Application Data

[63] Continuation-in-part of Ser. No. 948,678, Sep. 22, 1992, abandoned.

[51] Int. Cl.[6] ..... F23M 9/00

[52] U.S. Cl. ..... 431/183; 431/8; 431/185; 431/354; 239/404

[58] Field of Search ..... 431/158, 350, 353, 8, 431/9, 182, 183, 185, 265, 354; 239/402, 403, 404, 399

[56] References Cited

U.S. PATENT DOCUMENTS

| | | | |
|---|---|---|---|
| 972,056 | 10/1910 | Bunner | 431/354 |
| 1,071,053 | 8/1913 | Hunter | 431/354 |
| 1,194,740 | 8/1916 | Hunter | 431/354 |
| 1,659,573 | 2/1928 | Lalor | 431/354 |
| 2,785,742 | 3/1957 | Lovett | 431/354 |
| 3,391,981 | 7/1968 | Voorheis et al. | 431/354 |
| 3,648,457 | 3/1972 | Bobo | 431/183 |
| 3,749,548 | 7/1973 | Zink et al. | 431/183 |
| 3,864,073 | 2/1975 | Kolhi | 431/115 |
| 3,980,233 | 9/1976 | Simmons et al. | 239/400 |
| 4,033,714 | 7/1977 | Longworth | 431/354 |
| 4,220,444 | 9/1980 | Reed et al. | 431/348 |
| 4,246,757 | 1/1981 | Heberling | 431/183 |
| 4,383,820 | 5/1983 | Camacho | 431/187 |
| 4,472,136 | 9/1984 | Lefebvre | 431/186 |
| 4,595,355 | 6/1986 | Garrelfs et al. | 431/265 |
| 4,673,348 | 6/1987 | Riley | 126/91 A |
| 4,729,734 | 3/1988 | Polomchak et al. | 431/183 |

*Primary Examiner*—James C. Yeung
*Attorney, Agent, or Firm*—Welsh & Katz, Ltd.

[57] ABSTRACT

A heating devices for complete intermixing of gaseous fuel and air to allow complete combustion of the gas and air mixture in a mushroom shaped flame. The device includes an element for supplying an axial flow of air and a swirling device in fluid communication with the air supply to turbulently swirl and radially inward direct the air entering from the air supply. The heating device also includes an nozzle element located within a mixing chamber formed by the swirling device. The nozzle forms a plurality of bores to emit the fuel as generally radially outward directed streams into the swirling stream of air exiting from the swirling device to intermixes the fuel and air. A disk connected to the nozzle restrains the gas streams within the mixing chamber to facilitate the mixing of the fuel and air. The intermixed fuel and air is then ignited by an ignition device. A combustion chamber is disposed about an upper first end of the swirling device to contain the generated flame.

12 Claims, 2 Drawing Sheets

HEATING DEVICE

This is a continuation-in-part of Ser. No. 07/948,678, filed Sep. 22, 1992 abandoned.

BACKGROUND OF THE INVENTION

The present invention relates to heating devices and more particularly to heating devices having burners which are of the type which mix gaseous fuel with air before igniting the mixture in a combustion chamber which may include a furnace or boiler.

Within industry and housing there has been a long felt need to develop efficient heating devices. Heating devices which burn gaseous fuels such as natural gas or liquified petroleum gas are common. However, to obtain the maximum benefit from the heating device, the device must utilize fuel burners which intermix the fuel and air to cause a generally complete burning of the fuel thus providing the greatest fuel efficiency and eliminating noxious by-products such as carbon monoxide which may be formed by incomplete combustion.

One of the principle drawbacks found in prior art heating devices for mixing fuel and air and igniting the mixture is that the devices attempt to mix generally parallel flows of air and fuel through use of swirling devices. While such devices perform adequate intermixing at the boundary between the air and fuels, the efficiency of the intermixing declines away from the boundary which causes incomplete combustion and noxious by-products. In addition, the gaseous fuels are typically lighter than air so that upon the release of the gas from the gas supply, the gas rises which may prevent optimal intermixing the gas and air.

Another drawback of these heating devices is the devices typically employ a plurality of rotating swirling mechanisms to swirl the fuel and/or combustion air. The swirling mechanisms may require tight tolerances and exact alignment to function properly. During fabrication or maintenance, the tolerances may not be met or the parts may be misaligned, both of which may have a negative effect on the intermixing on the fuel and air for complete combustion.

A further drawback of these heating devices is they typically produce flames having a long length extending away from the burner and a small cross sectional diameter. Heat exchangers are typically designed so that large surface areas are to be heated which increases the efficiency of the heat transfer. Therefore, the flame geometry of the heating devices is not optimal to transfer the heat to these heat exchangers and also creates hot spots on the surface of the heat exchanger which leads to localized stress fracturing and corrosion of the surface.

Therefore, it is an object of the present invention to provide a heating device which performs a complete intermixing of fuel such as natural gas or vaporized liquified petroleum and air so that there may be complete combustion of the oil.

Another object of the present invention is to provide a heating device which employs a minimum amount of swirling devices which may require exact alignment to intermix the fuel and air.

A further object of the present invention is to provide a heating device which provide a flame having a short length and a wide diameter so that a large surface area of a heat exchanger may be heated without producing localized hot spots.

A still further object of the present invention is to provide a heating device which restrains the gaseous fuel in a burner to facilitate the mixing of the fuel with air before ignition of the mixture.

SUMMARY OF THE INVENTION

Accordingly, the above objects are satisfied by the present invention which provides a heating device having a gas burner which causes complete combustion of the gas and produces a flame having improved geometry for the heating of the surface of a heat exchanger. The heating device includes a burner assembly for intermixing gaseous fuel and air and a combustion chamber disposed about the upper end of the burner assembly for containment of the generated flame. The burner assembly has an air swirler within the upper end portion of a tubular housing and a gas emitting nozzle disposed within the air swirler. An outer conduit extends from the lower end of the tubular housing to supply a flow of air to the tubular housing and air swirler. The air swirler swirls the air to create turbulence and directs the air radially inward toward the nozzle. An inner conduit extends through the outer conduit and into the tubular housing to supply a flow of gas to the nozzle. The nozzle directs a plurality of streams of gas radially outward and directly into the air exiting the air swirler. The gas and air intermix so that complete combustion of the gas may take place. The burner includes an ignition device for igniting the mixture.

More particularly, the swirling device includes a lower annular baffle which is radially disposed about and connected to the inner conduit within the tubular housing. An outer annular baffle extends radially inward from the opening in the upper end of the tubular housing and defines a circular exit aperture. A plurality of fins extend vertically between the inner annular baffle and the outer annular baffle. The fins extend outward at a secant to a circle defined by the circular aperture. The swirling device turbulently swirls and inwardly directs the air passing through the tubular housing.

The nozzle is disposed between the upper and the lower annular baffle and includes a plurality of bores spaced about the circumference of a tubular member. The gas exits the tubular member through the bores as a plurality of streams which are directed generally radially outward into the air exiting the swirling device. The gas and air intermix to form a homogeneous mushroom shape configuration.

DETAILED DESCRIPTION OF THE PREFERRED EMBODIMENT

Figure 1:
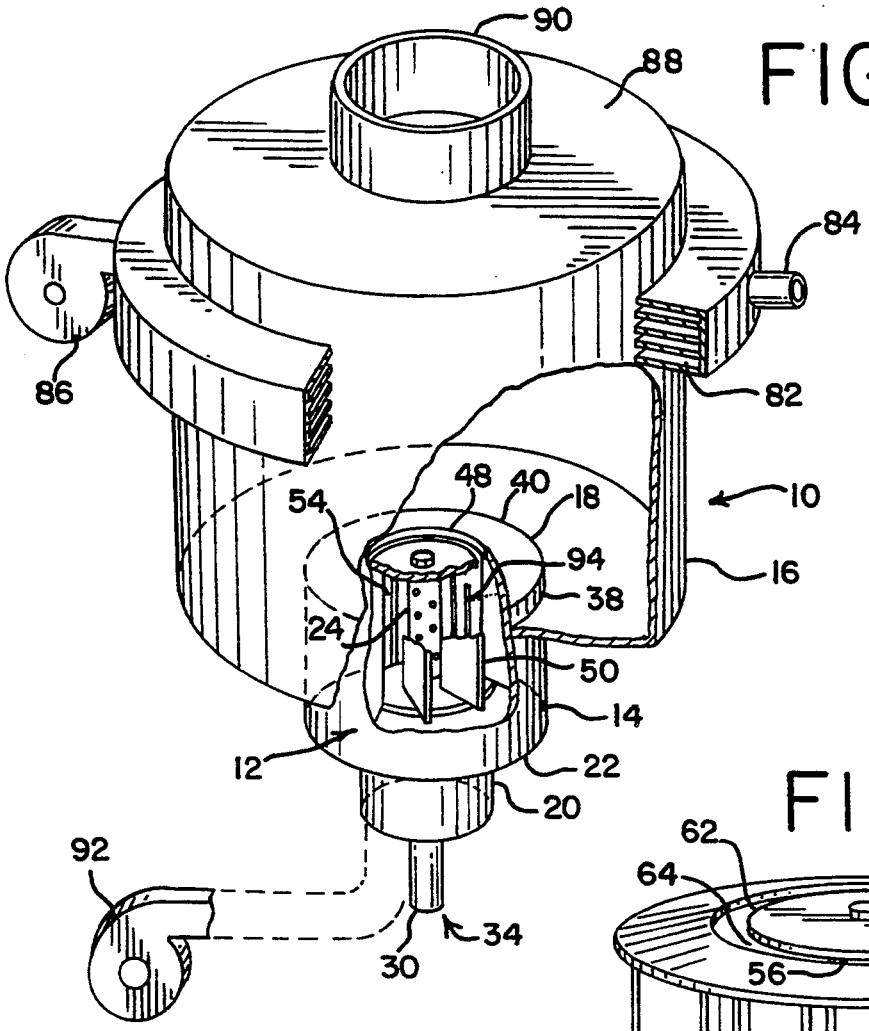
FIG. 1 is a front perspective view, partially broken away, of the improved heating device of the present invention.

Turning now to FIG. 1, a heating device 10 according to the present invention includes a burner assembly 12 for producing a mushroom shaped flame. The burner assembly 12 includes a tubular housing 14. A combustion chamber 16 for containing the flame is disposed about an exit end 18 of the tubular housing 14. Pressurized air is supplied to the tubular housing 14 by an outer conduit 20 which extends axially from the lower end 22 of the tubular housing 14.

The burner assembly 16 includes a nozzle 24 within the tubular housing 14. An inner conduit 30 extends axially through the outer conduit 20 and into the tubular housing 14 and is in fluid communication with the nozzle 24 to provide gaseous fuel 34 (FIG. 4) such as natural gas to the nozzle 24. The nozzle 24 has a top closure wall 36.

Figure 3:
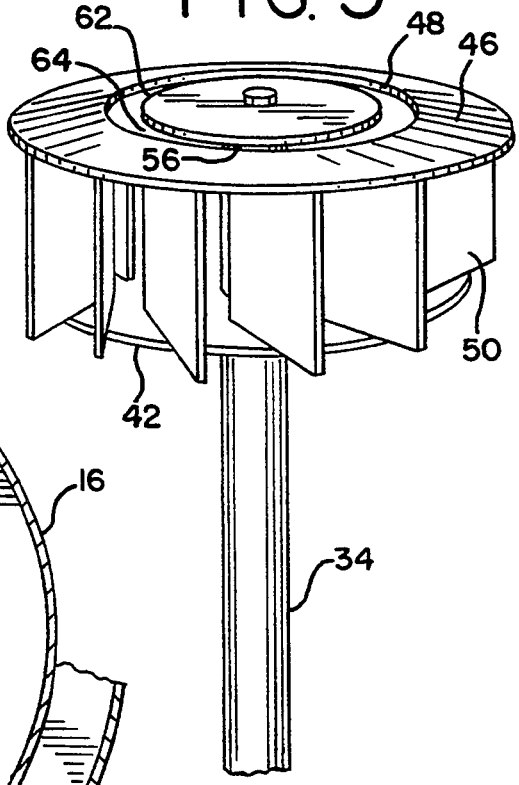
FIG. 3 is a front perspective view of an inner conduit, an inner baffle, a plurality of planar fins and an outer annular baffle used in the burner assembly of FIG. 1.
Figure 2:
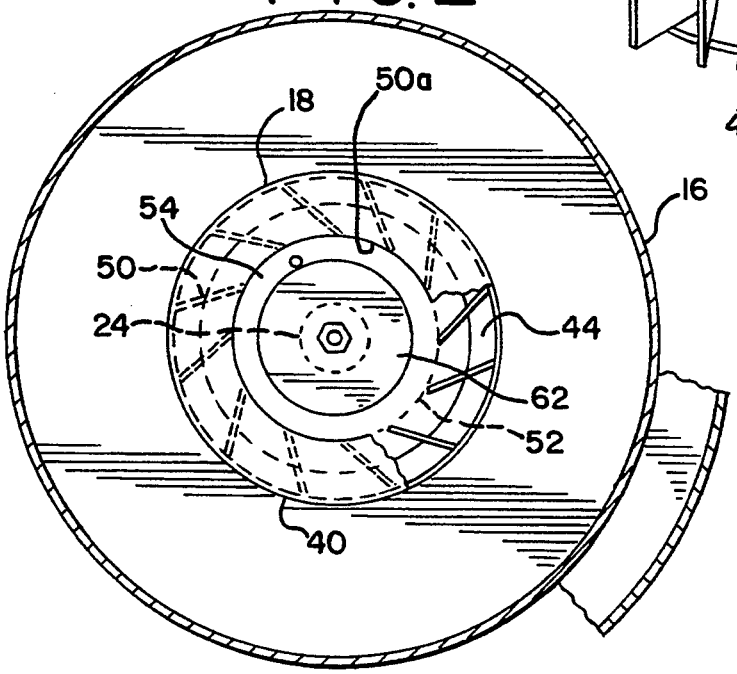
FIG. 2 is a top cut away view of the burner assembly of the present invention.
Figure 4:
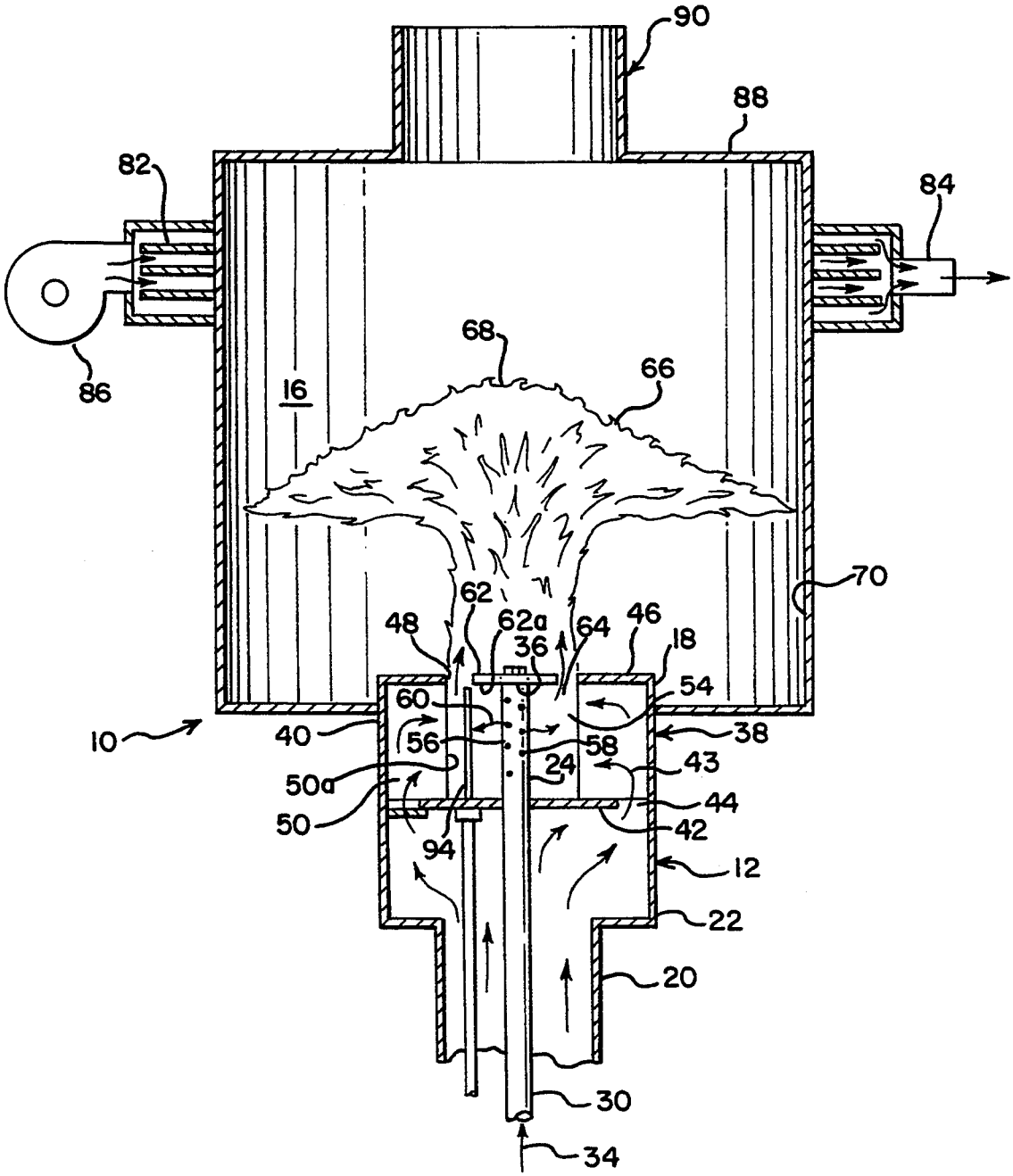
FIG. 4 is a vertical section of the improved heating device of the present invention.

As shown in FIGS. 1, 3 and 4 of the drawings, an air swirling device 38 is located within an exit end portion 40 of the tubular housing 14. The swirling device has a lower annular baffle 42 which is fixedly attached to and extends radially outward from the inner conduit 30 to form a circumferential gap 44 between the annular baffle and tubular housing 14. An outer annular baffle 46 extends radially inward from the exit end 18 of the tubular housing 14 and defines a circular exit aperture 48 concentric with the tubular housing.

A plurality of fins 50 are rigidly attached to the inner annular baffle 42 and vertically extend between the inner annular baffle 42 and outer annular baffle 46. The fins 50 are planar and angled to extend inward to form a secant with an imaginary circle 52 defined by the circular aperture 48 when viewed from the exit end 18 of the tubular housing 14. The inner edges 50*a* of the fins 50 do not necessarily need to end at the circle 52 as long as the radial width of the fins is sufficient to direct the air entering the swirling device 38 through the gap 44. The outer radial edges of the fins 50 should contact or be in close proximity to the tubular housing 14. The exit aperture 48, lower and upper baffles 42, 46 and inner edges 50*a* of the fins 50 define a mixing chamber 54 within the swirling device 38. Air 43 flowing along the tubular housing 14 toward the exit end portion 40 is directed radially outward by the lower baffle 42 through the gap 44, the air then flows axially between the fins 50. The lower and upper baffles 42, 46 then direct the air radially inward through the fins 50. As the air flows between the fins 50, the fins force the air 43 to move in a radially inwardly directed, highly turbulent circular swirling motion. In the preferred embodiment shown in FIG. 3, the fins 50 are rigidly attached preferably by means of welds or rivets to the outer annular baffle 46.

Referring to FIG. 4, the nozzle 24 is preferably tubular and located within the mixing chamber 54. The nozzle 24 includes a cylindrical wall 56 which extends axially outward from the inner baffle 42. Extending generally radially through the cylindrical wall 58 of the nozzle 24 is a plurality of bores 56. The bores 58 are preferably evenly circumferentially and axially spaced about the cylindrical wall 56. The gas 34 passing into the nozzle 24 from the inner conduit 30 exits the inner conduit through the bores 58 as generally radial outwardly directed streams 60. The streams 60 of gas are directed into the fins 50, and thus the radial inwardly directed flow of swirling turbulent air 43 exiting the fins 50 thereby intermixing the gas and air.

The nozzle 24 also preferably includes a restraining disk or flange 62 which is attached by a bolt to the closure wall 36 and extends radially outward in a direction normal to the extension of nozzle to form a radial exit gap 64 between the flange and swirling device 38. The flange 62 is preferably located in the exit aperture 48 and aligned with the outer baffle 46, but the flange may also be located lower than the upper annular baffle 46 as long as the nozzle 24 is disposed within the mixing chamber 54.

The flange 62 should dimensioned so that the flange occupies approximately 37.5% to 43.75% of the area defined by the exit aperture with the preferred percentage being 37.5%. The flange 62 acts to restrain the streams 60 of the gas 43 within the mixing chamber 54 to insure complete intermixing of the gas and air in the chamber. The flange 62 is particularly beneficial when the burner assembly 12 is vertically oriented because the gas, being lighter than air, may rise out of the mixing chamber 54 before sufficient intermixing occurs with the turbulent air 43 exiting the swirling device 38.

The intermixed gas and air exiting the burner assembly 12 form a homogeneous mushroom shape configuration 66 of gas and air which is surrounded by turbulent air flow. Ignition of the mushroom shaped configuration 66 produces an instantaneous mushroom shaped flame 68, which does not come into contact with an inner surface 70 of combustion chamber 46 thus preventing hot spots on the surface of the chamber. Further, the intermixed gas 36 and air causes an almost complete burning or oxidation of the gas. As a result, the efficiency of the heating device is very high, and noxious waste gases such as carbon monoxide are substantially eliminated as a by-product of the combustion.

It should be noted that the angle of the fins 50 may be varied, so long as inwardly directed turbulent swirling air is emitted from the swirling device so that when the intermixed gas 36 and air 43 are ignited, a mushroom shaped flame 68 is formed and the gas is thoroughly oxidized.

Returning to FIG. 1, in the preferred embodiment, the combustion chamber 16 contains a heat exchanger 82 which has a heat flue 84 extending therethrough. The heat from the mushroom shaped flame 68 is directed against a large surface area of the heat exchanger 82 thereby efficiently imparting heat to the heat flue 84 which contains air passing therethrough. The wide geometry of the mushroom shaped flame 68 prevents the formation of localized hot spots on the surface of the heat exchanger 82 which may cause failure of the heat exchanger. In a preferred embodiment, air may be directed through heat flue 84 by means of a blower 86. Alternatively, water may be passed through the heat flue 84 for use in hot water heat. At the top 88 of the combustion chamber 16, an exhaust vent 90 may be provided. It has been found that the noxious by-products from combustion of gaseous fuel 36 are so low that no exhaust vent is required. However, it may be desirable as a safety factor.

Conventional means for supplying air and gaseous fuel to the heating device 10 may be provided. For example, a tank, not shown, may be connected to the inner conduit 30 to supply outside source of gaseous fuel. Similarly, a blower 92 may be used for directing air into the outer conduit 20. Also, in order to ignite the mushroom shaped configuration 66, an ignition mechanism 94 to ignite the mixture of gas and air at the exit gap 64 extends through the inner flange 42 into the mixing chamber 54. The mixture should be ignited as close at a point within the mixing chamber 54 and in close proximity to the exit gap 64 to minimize the risks of explosion particularly when the mixture is first ignited. Either a pilot light or electronic ignition, as commonly known in the art, may be utilized as the ignition mechanism 94.

In an alternative embodiment of the invention, a heat exchanger 82 is not present, and the heat created by the mushroom shaped flame 68 is simply allowed to heat the combustion chamber 14 and radiate heat into the surrounding area. Similarly, the top 88 of combustion chamber 14 may be constructed either as a solid sheet of stainless steel, or as a grill. A novel and improved method for combustion of gaseous fuel with substantial elimination of noxious products is thereby provided.

A specific embodiment of the novel heating device according to the present invention has been described for the purposes of illustrating the manner in which the invention may be made and used. It should be understood that implementation of other variations and modifications of the invention in its various aspects will be apparent to those skilled in the art and that the invention is not limited by the specific embodiment described. It is therefore contemplated to cover by the present invention any and all modifications, variations, or equivalents that fall within the true spirit and scope of the basic underlying principles disclosed and claimed herein.

What is claimed is:

1. A heating device for intermixing fuel with air to form a mixture comprising:

air means for supplying an axial flow of the air;

swirling means in fluid communication with said air supply means for turbulently swirling and directing generally radially inward the air from said air supply means, said swirling means including, a portion of a tubular housing in fluid communication with said air means, said portion having an outer exit end and an outer annular baffle member extending radially inward from said portion and generally located at said exit end of said portion, said outer baffle member forming an exit aperture for emitting of the mixture, an inner annular baffle member circumferentially disposed about and extending radially outward from said fuel means to form a circumferential gap with said portion of said tubular housing, and a plurality of angled fins extending from said inner annular baffle member to said outer annular baffle member said outer baffle, said exit aperture, said inner baffle and the inner radial edges of said fins defining a mixing chamber;

means within said mixing chamber and inward of said outer baffle member for emitting the fuel as a plurality of streams directed generally radially outward into said swirling means; and means in communication with said emitting means for supplying the fuel to said emitting means wherein the fuel emitted from said emitting means intermixes with the inward directed air from said swirling means to form the mixture and the mixture is ignited to form a homogeneous mushroom shaped configuration surrounded by turbulent air flow.

2. The device of claim 1 wherein each of said fins extend inward on a secant to a circle defined by said exit aperture.

3. The device of claim 1 wherein said emitting means includes a nozzle having a plurality of bore means for directing the fuel generally radially outward from said nozzle into said swirling means.

4. The device of claim 1 wherein said emitting means includes a disk means for restraining the emitted gas within said mixing chamber to facilitate the intermixing of the emitted fuel with the air.

5. The device of claim 4 wherein said emitting means includes a nozzle having a plurality of bore means for directing the fuel generally radially outward from said nozzle, said fuel means being connected to an end of said nozzle, said disk means including a radial flange connected to an end of said nozzle.

6. The device of claim 5 wherein said nozzle is tubular and said bore means are circumferentially and axially spaced about the cylindrical wall of said nozzle.

7. The device of claim 1 wherein said emitting means includes a nozzle having an upper closure wall and a plurality of bore means for directing all the fuel supplied by said fuel supply means generally radially outward from said nozzle, said fuel means being connected to an end of said nozzle opposite said closure wall.

8. A heating device for intermixing fuel and air to form a mixture comprising:

a tubular housing member to allow the passage of air therethrough, said housing member having a first end and a second end;

first conduit member having a first end and a second end, said first conduit member being axially disposed within said housing member and extending into said housing member so as to allow the axial passage of gaseous fuel into said tubular housing member;

an inner annular baffle member attached to and extending generally radially outward from said first conduit member within said tubular housing member, said inner baffle member and said tubular housing defining a circumferential gap;

an outer annular baffle member circumferentially disposed in said second end of said tubular housing member and extending radially inward from said tubular housing to form an exit aperture;

a nozzle connected to and in fluid communication with said first conduit member, said nozzle defining a plurality of circumferentially spaced bores, the fuel exiting said nozzle through said bores, said nozzle being located between said outer baffle member and said inner baffle member;

a plurality of planar fins extending outward at a secant to a circle defined by said circular aperture, said fins extending from said outer annular member to said inner annular member, said upper baffle, said lower baffle and radial inner edges of said fins forming a mixing chamber, said bores being angled through said nozzle to direct the fuel into said fins; and disk means for restraining the gas emitted from said nozzle within said mixing chamber to facilitate the mixing of the gas and the air in said mixing chamber.

9. The device of claim 8 wherein said device includes a combustion chamber disposed about said second end of said tubular housing.

10. The device of claim 8 wherein said disk means is connected to and extends radially outward from said nozzle, said disk means being located in said exit aperture, and aligned with said outer baffle, said radial flange and said outer baffle forming a circumferential gap.

11. The device of claim 10 including ignition means for igniting the mixture within said mixing chamber.

12. The device of claim 8 wherein the disk means occupies 37.5% to 43.75% of the area defined by said circular aperture.

* * * * *